US006910263B2

(12) United States Patent
Naito

(10) Patent No.: US 6,910,263 B2
(45) Date of Patent: Jun. 28, 2005

(54) SELF-PIERCING RIVET SETTING APPARATUS AND SYSTEM

(75) Inventor: Nobuharu Naito, Toyohashi (JP)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/854,320

(22) Filed: May 26, 2004

(65) Prior Publication Data

US 2004/0216304 A1 Nov. 4, 2004

Related U.S. Application Data

(63) Continuation of application No. PCT/US02/39910, filed on Dec. 13, 2002.

(30) Foreign Application Priority Data

Dec. 25, 2001 (JP) ..... 2001-391576

(51) Int. Cl.[7] ..... B23P 19/00
(52) U.S. Cl. ..... 29/798; 29/432.2; 29/243.53
(58) Field of Search ..... 29/798, 245.53, 29/432.1, 432.2, 524.1, 715, 788, 796

(56) References Cited

U.S. PATENT DOCUMENTS 1,279,362 A * 9/1918 Krueger ..... 83/690
2,465,534 A * 3/1949 Havener ..... 29/525.06
5,722,144 A 3/1998 Bora
5,752,305 A 5/1998 Cotterill et al.
6,161,279 A * 12/2000 Suboski ..... 29/798
6,263,560 B1 7/2001 Edwards
6,276,050 B1 8/2001 Mauer et al.
6,385,843 B1 5/2002 Singh et al.
6,742,235 B2 * 6/2004 Blacket et al. ..... 29/432.2
6,842,962 B1 * 1/2005 Blacket ..... 29/525.06
2004/0261259 A1 * 12/2004 Naito ..... 29/798

* cited by examiner

*Primary Examiner*—David P. Bryant
(74) *Attorney, Agent, or Firm*—Harness, Dickey & Pierce, P.L.C.

(57) ABSTRACT

A self-piercing rivet setting apparatus (9) comprises a punch (14) and a die (18) for driving a self-piercing rivet into a plurality of workpieces including a receiving-side workpiece adjacent to the die. The self-piercing rivet has a large-diameter head and a hollowed leg. The leg is driven to pierce the workpieces while allowing the front end of the leg to be expanded and deformed in its radial outward direction and to be stayed in the receiving-side workpiece without passing therethrough, to connect the plurality of workpieces with each other by the expanded leg and the head. The die includes a first die member (26) having a first cavity (25), and a second die member (30) having a second cavity (27) and a protruding pin (29) provided at the center of the second cavity. The first cavity is adapted to allow the leg of the self-piercing to be driven into the workpieces in a straight direction when the self-piercing rivet is pressed by the punch (14). The second cavity and the protruding pin are adapted to allow the leg of the self-piercing rivet being piercing the workpieces to be expanded and deformed in its radial outward direction.

5 Claims, 4 Drawing Sheets

SELF-PIERCING RIVET SETTING APPARATUS AND SYSTEM

CROSS REFERENCE TO OTHER APPLICATIONS

The present application is a continuation of pending international patent application PCT/US02/39910, filed Dec. 13, 2002 which designates the United States, and which claims priority of Japanese patent application 2001-391576, filed Dec. 25, 2001.

FIELD OF THE INVENTION

The present invention relates to a self-piercing rivet setting apparatus for setting, into a plurality of workpieces, a self-piercing rivet having a large-diameter head and a hollowed leg extending from the head. More specifically, the present invention relates to the self-piercing rivet setting apparatus for connecting a plurality of workpieces, such as two or more panels (or a panel and a component), by using a self-piercing rivet in a sheet-metal assembly operation such as automobile assembling (particularly, an aluminum body assembly operation).

One example of a self-piercing rivet setting apparatus is described in Japanese Patent Laid-Open No. 08-505087. FIG. 1 in this publication shows one example of a self-piercing rivet. The self-piercing rivet comprises a large-diameter head and a hollowed leg extending from the head. When the self-piercing rivet is driven into workpieces, such as two body panels, by a punch and a die of the setting apparatus, the front end of the leg is expanded and deformed as the leg pierces the panels, and the panels are finally connected with each other by the expanded leg and the head. The self-piercing rivet is suitable for connecting aluminum body panels to which welding is not applicable. The demand for the self-piercing rivet is increasing because aluminum bodies are increasingly employed to facilitate weight reduction in automobile bodies. In particular, since the self-piercing rivet is driven to pierce a punch-side workpiece but stay in a receiving-side workpiece adjacent to the die without passing therethrough, the rivet does not form any opening in the surface of the receiving-side workpiece. This advantageously maintains a sealing performance and good appearance of the receiving-side workpiece.

In a conventional self-piercing-rivet driving operation, if the punch-side workpiece has a greater thickness in a rivet-driving direction than that of the receiving-side workpiece adjacent to the die, a radial piercing length, that is, an undercut amount of the leg of the rivet obliquely piercing the receiving-side workpiece can be reduced, resulting in insufficient connecting strength. Such a condition will be described in conjunction with FIG. 1. FIG. 1 shows the condition when a self-piercing rivet 1 is driven into two workpieces 2 and 3 to connect the punch-side workpiece 2 (a plurality of punch-side workpieces may be provided in lieu of the illustrated example) with the receiving-side workpiece 3 adjacent to the die. The self-piercing rivet 1 has a large-diameter head 5 and a hollowed leg 6 extending from the head. When the punch-side workpiece 2 has a greater thickness than that of the receiving-side workpiece 3 as shown in FIG. 1, the radial piercing length or the undercut amount 7 of the leg of the rivet obliquely piercing the receiving-side workpiece is reduced, and thereby the workpiece 3 cannot be connected to the workpiece 2 with a sufficient strength. At the preset stage, it is typically required to limit a ratio of the thickness of the punch-side workpiece to the thickness the receiving-side workpiece adjacent to the die no more than the ratio of 2 to 1 (2:1) to assure a sufficient connecting force.

The above limitation (or the need for preventing the receiving-side workpiece from having a thickness of one-half or less of the thickness of the other workpiece in a self-piercing rivet driving region of the workpieces) imposes the restriction on the rivet-driving direction. For example, in FIG. 1, if the ratio of the thickness of the workpiece 2 to the other workpiece 3 exceeds 2:1 such as 3:1 or 4:1, and the self-piercing rivet is driven into the workpiece 3 as the receiving-side workpiece, an insufficient undercut amount 7 is resulted to thereby obtain undesired connecting strength. Thus, the workpiece 2 must be placed as the receiving-side workpiece by turning over the rivet setting apparatus or turning over both the workpiece 2 and the workpiece 3 to connect the workpiece 2 to the workpiece 3 with a sufficient strength. However, the rivet-setting operation cannot be carried out at a desirably increased speed due to a time required for turning over the setting apparatus or the workpieces. Besides, the turning-over operation per se can get into difficulties due to the restrictions on the workpiece shapes, the rivet-driving region and other factors.

It is therefore an object of the present invention to provide a self-piercing rivet setting apparatus capable of reducing or eliminating the restriction on a rivet-driving direction with respect to a workpiece.

SUMMARY OF THE INVENTION

In order to achieve the above object, the present invention provides a self-piercing rivet setting apparatus comprising a punch and a die for driving a self-piercing rivet into a plurality of workpieces including a receiving-side workpiece adjacent to the die. The self-piercing rivet has a large-diameter head and a hollowed leg extending from the head. In this self-piercing rivet setting apparatus, when the self-piercing rivet is driven into the workpieces, the leg is driven to pierce the workpieces while allowing the front end of the leg to be expanded and deformed in its radial outward direction and to be stayed in the receiving-side workpiece adjacent to the die without passing therethrough, to connect the plurality of workpieces with each other by the expanded leg and the head. Further, in the self-piercing rivet setting apparatus, the die includes a first die member having a first cavity, and a second die member having a second cavity and a protruding pin provided at the center of the second cavity. The first cavity is adapted to allow the leg of the self-piercing rivet to be driven into the workpieces in a straight direction when the self-piercing rivet is pressed against the first die member by the punch. The second cavity and the protruding pin of the second die member are adapted to allow the leg of the self-piercing rivet being piercing the workpieces to be expanded and deformed in its radial outward direction.

According to the above self-piercing rivet setting apparatus, until the front end of the leg of the self-piercing rivet starts piercing the receiving-side workpiece adjacent to the die, the first die member allows the leg to be driven into the workpiece in a straight direction. Then, when the leg starts piercing the receiving-side workpiece, the front end of the leg is widely expanded in its radial outward direction by the second die member to provide a sufficient undercut amount. The sufficient undercut amount can achieve an adequate connecting force even if the receiving-side workpiece has a thin thickness of one-half or less of that of the other workpiece (or the punch-side workpiece). This makes it possible to reduce or eliminate the restriction on the rivet-driving direction with respect to the workpieces. Thus, the complicated operation of turning over either the setting apparatus or the workpieces as in the conventional setting apparatus can be skipped or omitted to thereby achieve a speedy setting operation. Further, the setting operation can be carried out even in the conventionally impossible rivet-driving direction. The eliminated restriction on the rivet-driving region provides widened applicable area or region suitable for the self-piercing rivet setting operation.

In the above self-piercing rivet setting apparatus, the first die member may be disposed at a position facing with the punch until the leg of the self-piercing rivet is driven into the workpieces in a straight direction and starts piercing the receiving-side workpiece adjacent to the first die member. Then, the second die member may be disposed at the position facing with the punch in place of the first die member to allow the leg of the self-piercing rivet being piercing the receiving-side workpiece to be expanded and deformed in its radial outward direction when the leg of the self-piercing rivet starts piercing the receiving-side workpiece. The setting apparatus may further include a C-shaped frame. In that case, the punch is attached to one of the ends of the C-shaped frame to be movable toward the other end of the C-shaped frame, and the first and second die members are attached to the other end of the C-shaped frame. Further, the other end of the C-shaped frame is provided with a rotary table for supporting the first and second die members. The rotary table is operable to allow either one of the first and second die members to be selectively positioned at the position facing with the punch to receive the self-piercing rivet to be driven by the punch. In the self-piercing rivet setting apparatus according to the present invention, the number of the die members is not limited to two but it may be three or more. Further, these die members may be selectively replaced depending on a piercing depth of the self-piercing rivet.

The present invention also provides a self-piercing rivet setting system having self-piercing rivet setting apparatuses each including a punch and a die for driving a self-piercing rivet into a plurality of workpieces having a receiving-side workpiece adjacent to the die, the self-piercing rivet having a large-diameter head and a hollowed leg extending from the head, wherein when the self-piercing rivet is driven into the workpieces, the leg is driven to pierce the workpieces while allowing the front end of the leg to be expanded and deformed in its radial outward direction and to be stayed in the receiving-side workpiece adjacent to the die without passing therethrough to connect the plurality of workpieces with each other by the expanded leg and the head. The self-piercing rivet setting system of the present invention comprises a first self-piercing rivet setting apparatus including a first die which has a first cavity, the first cavity of the first die member being adapted to allow the leg of the self-piercing rivet to be driven into the workpieces in a straight direction when the self-piercing rivet is pressed against the first die by the punch; a second self-piercing rivet setting apparatus including a second die which has a second cavity and a protruding pin provided at the center of the second cavity, the second cavity and protruding pin of the second die member being adapted to allow the leg of the self-piercing rivet being piercing the workpieces to be expanded and deformed in its radial outward direction; and exchanging means for placing the first self-piercing rivet setting apparatus with respect to the workpieces until the leg of the self-piercing rivet is driven into the workpieces in a straight direction and starts piercing the receiving-side workpiece, and for placing the second self-piercing rivet setting apparatus with respect to the workpiece in place of the first self-piercing rivet setting apparatus to allow the leg of the self-piercing rivet being piercing the receiving-side workpiece to be expanded and deformed in its radial outward direction when the leg of the self-piercing rivet starts piercing the receiving-side workpiece.

According to this system, the first self-piercing rivet setting apparatus allows the leg to be driven into the workpiece in a straight direction until the front end of the leg of the self-piercing rivet starts piercing the receiving-side workpiece adjacent to the die. Then, when the leg starts piercing the receiving-side workpiece, the front end of the leg is widely expanded in its radial outward direction by the second self-piercing rivet setting apparatus, to provide a sufficient undercut amount. The sufficient undercut amount can achieve a desired connecting force even if the receiving-side workpiece has a thin thickness of one-half or less of that of the punch-side workpiece. This makes it possible to reduce or eliminate the restriction on the rivet-driving direction with respect to the workpieces. Thus, the complicated operation of turning over either the setting apparatus or the workpieces as seen in the conventional setting apparatus can be skipped or omitted to achieve a speedy setting operation. Further, the setting operation can be carried out even in the conventionally impossible rivet-driving direction. The eliminated restriction on the rivet-driving region provides widened applicable area or region suitable for the self-piercing rivet setting operation.

DETAILED DESCRIPTION OF THE PREFERRED EMBODIMENT

Figure 1:
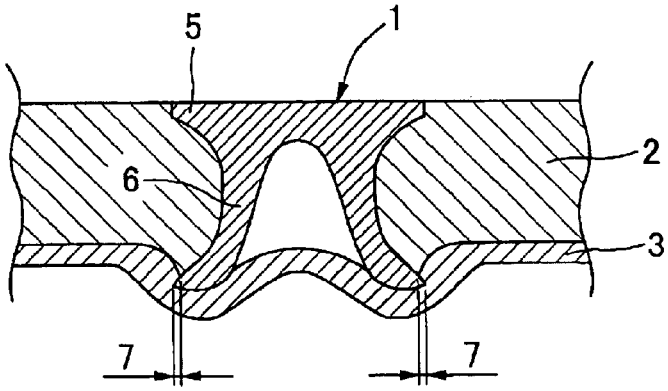
FIG. 1 (PRIOR ART)
FIG. 1 is a sectional view showing connected workpieces with a self-piercing rivet driven by a conventional setting apparatus.
Figure 2:
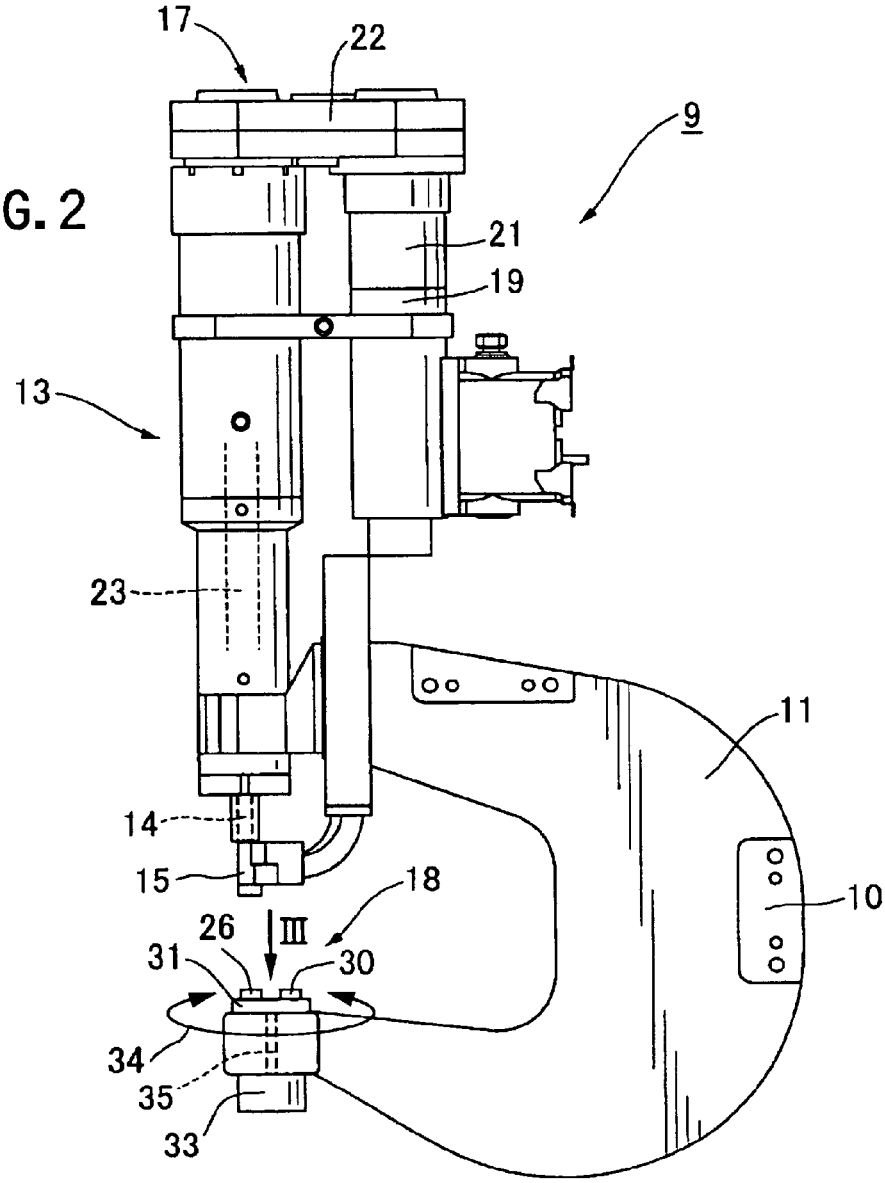
FIG. 2 is a front view of a self-piercing rivet setting apparatus according to one embodiment of the present invention.

With reference to the drawings, an embodiment of the present invention will now be described. FIG. 2 schematically shows the entire structure of a self-piercing rivet setting apparatus 9 according one embodiment of the present invention. In FIG. 2, the self-piercing rivet setting apparatus 9 includes a C-shaped frame 11 having a coupling portion 10 to be coupled with an articulated robot arm (not shown). The C-shaped frame 3 is an integral rigid body including an upper horizontal arm, a vertical arm having the coupling portion 10 attached thereto, and a lower horizontal arm. A rivet setting assembly 13 of the self-piercing rivet setting apparatus is attached to or one of the ends or the end of the upper horizontal arm of the C-shaped frame 11. The setting assembly 13 is provided with a punch 14 movably attached to the front-end (the lower end in FIG. 2) thereof. A receiver unit 15 extends from the punch 14 to the front-end side. A self-piercing rivet (see the self-piercing rivet 1 in FIG. 1) is fed to and held in the receiver unit 15 and driven by the punch 14. A spindle type driving unit 17 is provided on the upper side of the punch 14. The spindle type driving unit 17 is operable to press the punch 14 so as to drive the self-piercing rivet held in the receiver unit on the lower side of the punch. A die 18 is attached to the other end or the end of the lower horizontal arm of the C-shaped frame 11. For example, the spindle type driving unit 17 comprises an electric driving motor, a reduction gear assembly 21 and a gear assembly 22 for transmitting a rotation force of the motor, and a spindle 23 adapted to move vertically while rotating according to the rotation force of the motor through a belt. When the spindle moves downward according the rotation force of the motor, this movement is transmitted to the punch 14, and then the punch 14 strongly presses the self-piercing rivet held in the receiver unit 15, toward the die 18. A plurality of workpieces (for example, see the workpieces 2 and 3 in FIG. 1) are placed on the die 18. According to the downward movement of the punch 14, the self-piercing rivet is driven into the plurality of workpieces to connect these workpieces with each other. The C-shaped frame 11 elastically supports the setting assembly 13 and the die 18 to absorb an impact force during the rivet-driving operation.

Figure 3:
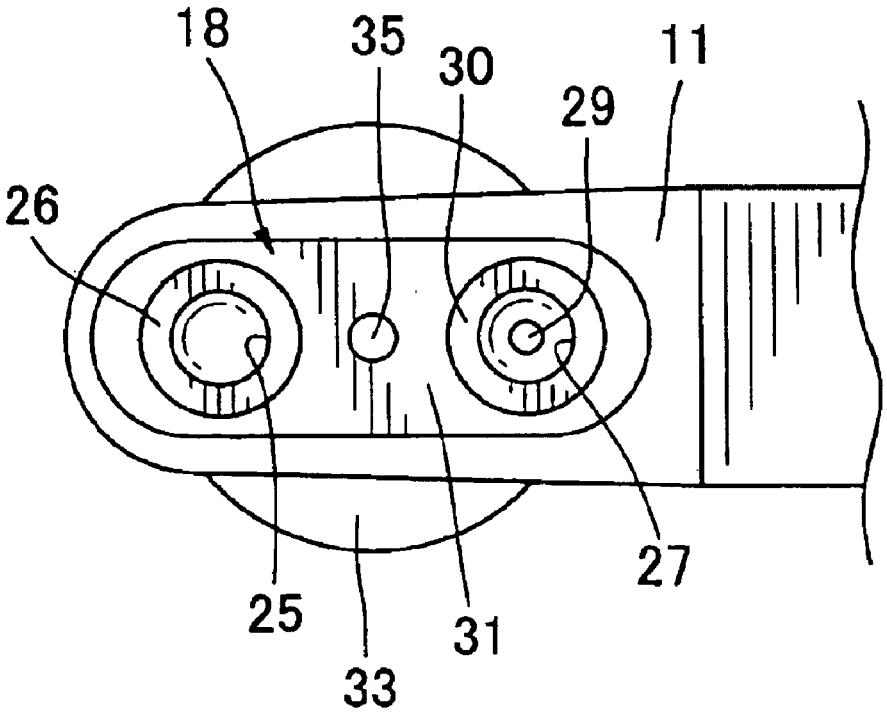
FIG. 3 is a top plan view of a die when seeing from the arrow III of the self-piercing rivet setting apparatus in FIG. 2.

In the present invention, the die 18 comprises a plurality of die members. In FIGS. 2 and 3, the die 18 includes a first die member 26 having a cavity 25 adapted to allow the leg of the self-piercing rivet to be driven into the workpieces in a straight direction when the self-piercing rivet is pressed by the punch, and a second die member 30 having a cavity 27 and a protruding pin 29 provided at the center of the cavity 27 which are adapted to allow the leg of the self-piercing rivet being piercing the workpieces to be expanded and deformed in its radial outward direction. While the illustrated embodiment has the die 18 comprised of two die members, the die 18 may be comprised of three or more die members each having a different shape. In the illustrated embodiment, the cavity 25 of the first die member 26 is formed as a simple cylindrical hole having a diameter capable of receiving a pressure deformation of the workpieces caused by a pressing force of the leg of the self-piercing rivet. The cavity 27 of the second die member 30 is formed as a cylindrical hole which surrounds the central protruding pin 29, and has a diameter greater than the outer diameter of the leg and a depth less than the cavity 25 to expandingly deform the leg of the self-piercing rivet in its radial outward direction.

The first die member 26 and the second die member 30 are attached onto a rotary table 31. According to rotation of the rotary table, either one of the first and second die members 26 and 30 is selectively positioned at a position facing with the punch to receive the self-piercing rivet to be driven by the punch 14. To this end, a rotational drive device 33 such as a motor attached to the C-shaped frame is provided to rotate the rotary table 31 about a shaft 35 in FIG. 3 as shown by the arrow in FIG. 2 to position either one of the first and second die members 26 and 30 below the punch 14. Further, a control unit (not shown) of the self-piercing rivet setting apparatus 9 controls the rotational drive device 33 to position either one of the first and second die members 26 and 30 below the punch 14 at a predetermined timing.

Figure 4:
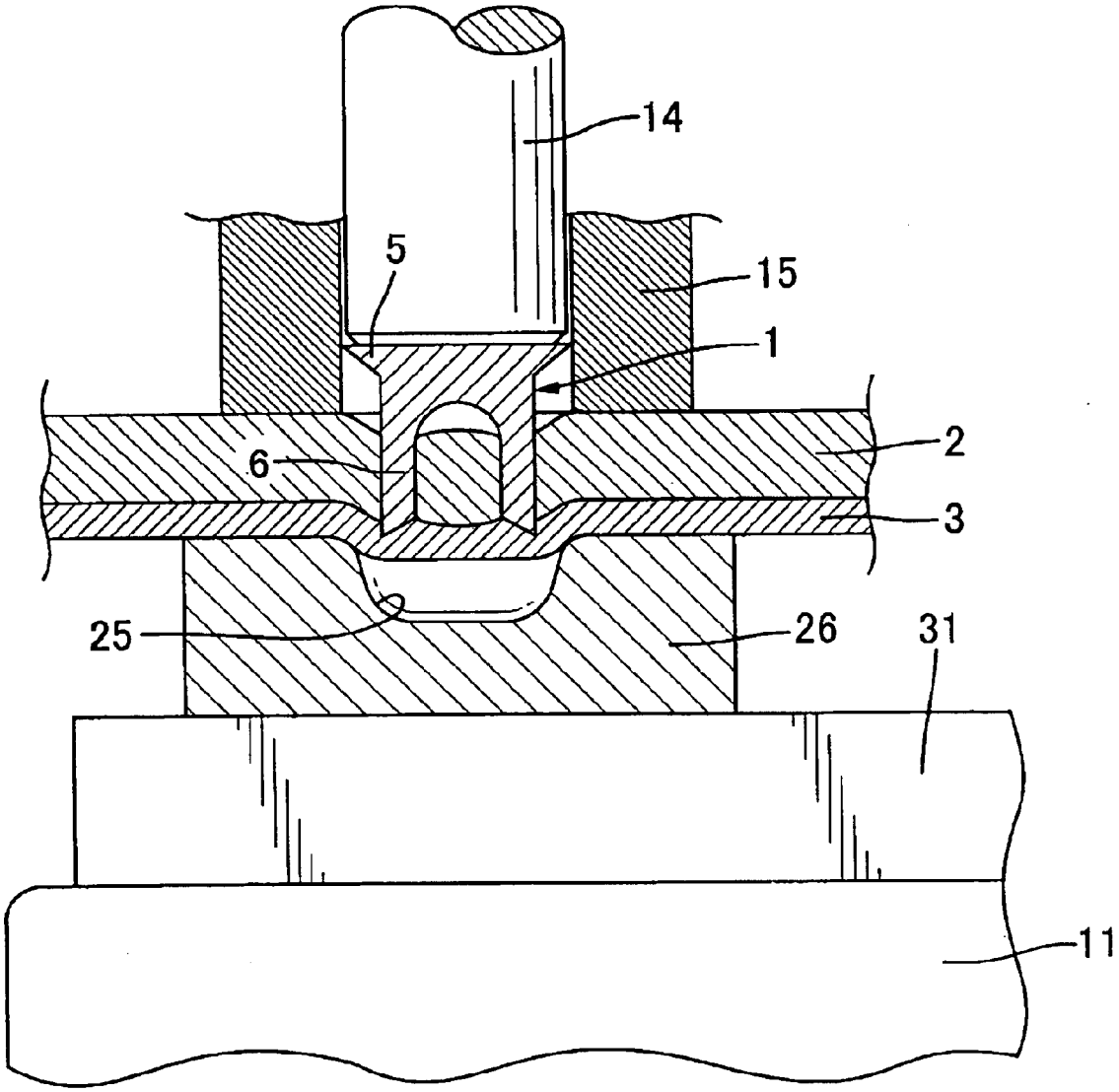
FIG. 4 is a sectional view of a first die member and a punch in the condition when a self-piercing rivet is being driven into workpieces by using the first die member of the self-piercing rivet setting apparatus shown in FIGS. 2 and 3.
Figure 5:
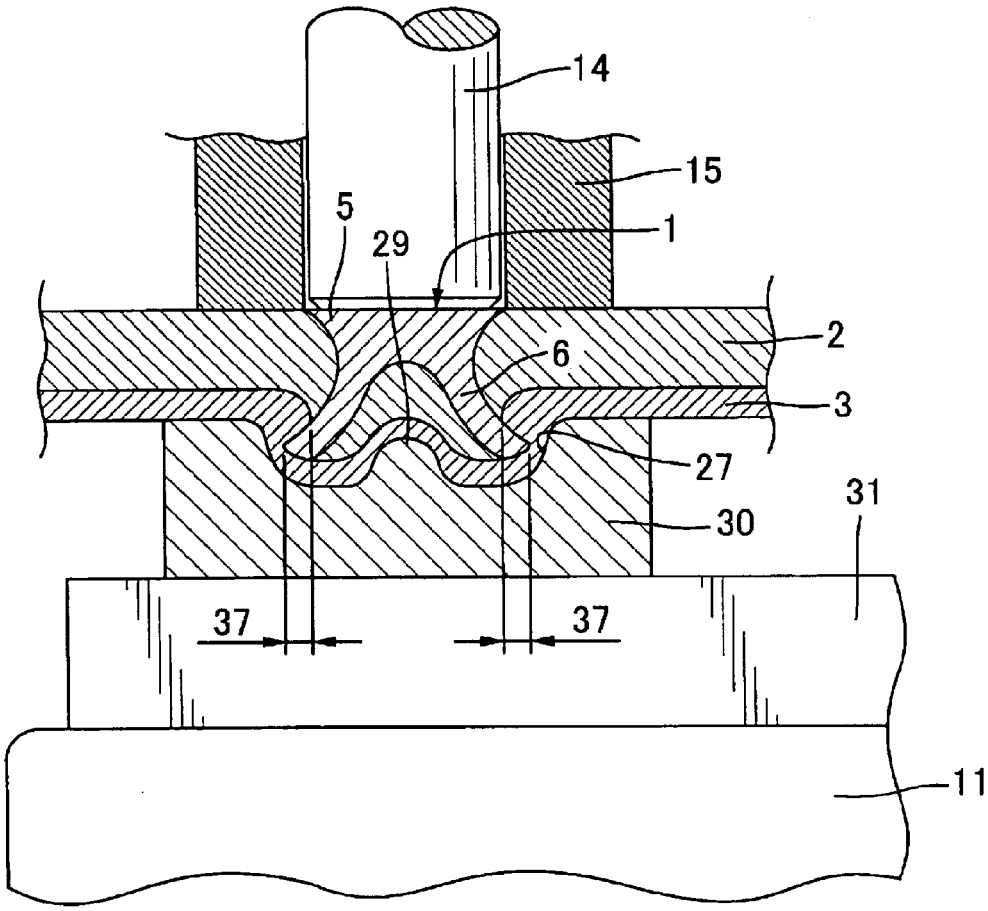
FIG. 5 is a sectional view of a second die member and the punch in the condition when a self-piercing rivet is driven into workpieces to connect the workpieces with each other by using the second die member of the self-piercing rivet setting apparatus shown in FIGS. 2 and 3.

With reference to FIGS. 4 and 5, an operation of driving the self-piercing rivet using the self-piercing rivet setting apparatus 9 will be described below. In FIG. 4, the self-piercing rivet 1 is automatically fed from a feeding unit (not shown) to the receiver unit 15, and held in the receiver unit 15 to locate it below the punch 14. The workpieces 2 and 3 to be connected with one another are placed between the die 18 and the punch 14. It is to be understood that the number of the workpieces may be tow or more. In the present invention, at a first step of the rivet-driving operation, the first die member 26 is positioned below the punch 14 by the rotation of the rotary table 31. The punch 14 is moved downward by the spindle type driving unit 17 (FIG. 2) to drive the self-piercing rivet 1 into the punch-side workpiece 2. During this rivet-driving operation, the hollowed leg 6 of the self-piercing rivet 1 progressively pierces the workpiece 2, and the configuration of the cavity 25 of the first die member 26 allows the leg 6 of the self-piercing rivet 1 to be driven into the workpiece 2 in a straight direction. The punch 14 continues to press the self-piercing rivet until the piercing depth of the leg 6 reaches the receiving-side workpiece 3 adjacent to the first die member 26. When the leg 6 starts piercing the receiving-side workpiece 3, the resulting reaction force is transmitted to the punch 14. At detecting of the reaction force, the spindle type driving unit 17 temporarily stops providing the pressing force to the punch 14.

After the pressing force to the punch 14 is stopped, the rotary table 31 is rotated to position the second die member 30 at a position below the punch 14 and under the receiving-side workpiece 3 of the workpieces 2 and 3. After the second die member 30 is positioned in its place, the spindle type driving unit 17 applies the pressing force to the punch 14 again to restart driving into the receiving-side workpiece 3 the self-piercing rivet which has just started piercing the receiving-side workpiece 3. The configuration of the cavity 27 and the central protruding pin 29 of the second die member allows the leg 6 of the self-piercing rivet being piercing the receiving-side workpiece 3 to be expanded and deformed in its radial outward direction. Referring to FIG. 5, when the front end of the leg 6 of the self-piercing rivet 1 pierces the receiving-side workpiece 3 adjacent to the second die member 30, the top of the protruding pin 29 contacts the die-facing side of the receiving-side workpiece 3. The protruding pin 29 acts to stick the contact area of the receiving-side workpiece 3 due to the pressure of the receiving-side workpiece by the pressing force of the punch 14. Since the protruding pin 29 is located at the center of the opening of the leg 6 of the self-piercing rivet, the front end of the leg 6 of the self-piercing rivet 1 is widely expanded in its radial outward direction. Thus, the leg 6 is expanded and deformed widely in its radial outward direction to pierce the receiving-side workpiece. Then, the rivet-driving operation is completed before the front end of the led 6 is pushed through the receiving-side workpiece. As a result, the leg 6 is largely deformed in its radial direction to provide a sufficient piercing length or undercut amount 37 in the radial direction of the leg 6. The two workpieces 2 and 3 are connected with each other by the expanded and deformed leg 6 and the large-diameter head 5. In the present invention, the sufficient undercut amount 37 of the expanded leg 6 allows the workpieces 2 and 3 to be connected with an adequate connecting force even if the receiving-side workpiece 3 has a thin thickness of one-half or less of the other workpiece (or the punch-side workpiece). This makes it possible to reduce or eliminate the restriction on the rivet-driving direction with respect to the workpieces. Thus, the complicated operation of turning over the setting apparatus or the workpieces as in the conventional self-piercing rivet setting apparatus can be skipped or omitted to achieve a speedy setting operation. Further, the setting operation can be carried out even in the conventionally impossible rivet-driving direction. The eliminated restriction on the rivet-driving region provides widened applicable area or region suitable for the self-piercing rivet setting operation.

When the number of the die members is three or more, a cavity of a die member corresponding to the first die member is formed in a configuration allowing the leg of the self-piercing rivet to be driven into the workpieces in a straight direction until the front end of the leg reaches a receiving-side workpiece. With respect to the remaining die members corresponding to the second die member, a cavity and a protruding pin of each die member are formed in respective configurations varied to the other die members to thereby allow the leg of the self-piercing rivet to be widely expanded in its radial outward direction after the front end of the leg reaches the receiving-side workpiece. When the self-piercing rivet is driven into a plurality of workpieces, the die members are sequentially replaced while controlling the punch to repeat the pressing operation to the self-piercing rivet and the stop of the pressing operation.

In another embodiment, a self-piercing rivet setting system is provided. This self-piercing rivet setting system comprises a first self-piercing rivet setting apparatus and a second self-piercing rivet setting apparatus. The first self-piercing rivet setting apparatus includes a first die which has a first cavity. The second self-piercing rivet setting apparatus includes a second die which has a second cavity and a protruding pin provided at the center of the second cavity. In this embodiment, the first cavity of the first self-piercing rivet setting apparatus is adapted to allow the leg of the self-piercing rivet to be driven into the workpieces in a straight direction when the self-piercing rivet is pressed by the punch. The second cavity and the protruding pin of the second self-piercing rivet setting apparatus are adapted to allow the leg of the self-piercing rivet being piercing the workpieces to be expanded and deformed in its radial outward direction. The self-piercing rivet setting system further include exchanging means for placing the first self-piercing rivet setting apparatus to the workpieces until the leg of the self-piercing rivet is driven into the workpieces in a straight direction and starts piercing the receiving-side workpiece, and for placing the second self-piercing rivet setting apparatus to the workpiece in place of the first self-piercing rivet setting apparatus to allow the leg of the self-piercing rivet being piercing the receiving-side workpiece to be expanded and deformed in its radial outward direction when the leg of the self-piercing rivet starts piercing the receiving-side workpiece. The exchanging means for replacing and positioning the first and second self-piercing rivet setting apparatuses may be achieved by use of a tool changer.

According to the present invention, until the front end of the leg of the self-piercing rivet starts piercing the receiving-side workpiece adjacent to the die, the protruding pin does not act on the receiving-side workpiece. Then, when the front end of the leg of the self-piercing rivet starts piercing the receiving-side workpiece, the protruding pin reliably acts on the receiving-side workpiece. Thus, the leg is driven into the workpieces in a straight direction until the leg enters in the receiving-side workpiece. However, when the leg starts piercing the receiving-side workpiece, the protruding pin acts to widely expand the front end of the leg in its radial outward direction to provide a sufficient undercut amount. The sufficient undercut amount can achieve an adequate connecting force even if the receiving-side workpiece has a thin thickness of one-half or less of that of the other workpiece (or the punch-side workpiece). This makes it possible to reduce or eliminate the restriction on the rivet-driving direction with respect to the workpieces. Thus, the complicated operation of turning over the setting apparatus or the workpieces as in the conventional setting apparatus can be skipped or omitted to achieve a speedy setting operation. Further, the setting operation can be carried out even in the conventionally impossible rivet-driving direction. The eliminated restriction on the rivet-driving region provides widened applicable area or region suitable for the self-piercing rivet setting operation.

I claim:

1. A self-piercing rivet setting apparatus comprising a punch and a die for driving a self-piercing rivet into a plurality of workpieces including a receiving-side workpiece adjacent to the die, the self-piercing rivet having a large-diameter head and a hollowed leg extending from the head, wherein when the self-piercing rivet is driven into the workpieces, the leg is driven to pierce the workpieces while allowing the front end of the leg to be expanded and deformed in its radial outward direction and to be stayed in the receiving-side workpiece adjacent to the die without passing therethrough to connect the plurality of workpieces with each other by the expanded leg and the head; and wherein the die includes a first die member having a first cavity, and a second die member having a second cavity and a protruding pin provided at the center of the second cavity, the first cavity being adapted to allow the leg of the self-piercing rivet to be driven into the workpieces in a straight direction when the self-piercing rivet is pressed against the first die member by the punch, and the second cavity and protruding pin of the second die member being adapted to allow the leg of the self-piercing rivet being piercing the workpieces to be expanded and deformed in its radial outward direction.

2. The apparatus as defined in claim 1, wherein the first die member is disposed at a position facing with the punch until the leg of the self-piercing rivet is driven into the workpieces in a straight direction and starts piercing the receiving-side workpiece adjacent to the first die member, and the second die member is disposed at the position facing with the punch in place of the first die member to allow the leg of the self-piercing rivet being piercing the receiving-side workpiece to be expanded and deformed in its radial outward direction when the leg of the self-piercing rivet starts piercing the receiving-side workpiece.

3. The apparatus as defined in claim 2 further including a C-shaped frame, wherein the punch is attached to one of the ends of the C-shaped frame to be movable toward the other end of the C-shaped frame, and the first and second die members are attached to the other end of the C-shaped frame, and wherein the other end of the C-shaped frame is provided with a rotary table for supporting the first and second die members, the rotary table being operable to allow either one of the first and second die members to be selectively positioned at the position facing with the punch so as to receive the self-piercing rivet to be driven by the punch.

4. The apparatus as defined in claim 1, which includes a plurality of die members to be replaceably used as at least one of the first and second die members, depending on a piercing depth of the leg of the self-piercing rivet with respect to the workpieces.

5. A self-piercing rivet setting system having self-piercing rivet setting apparatuses each including a punch and a die for driving a self-piercing rivet into a plurality of workpieces having a receiving-side workpiece adjacent to the die, the self-piercing rivet having a large-diameter head and a hollowed leg extending from the head, wherein when the self-piercing rivet is driven into the workpieces, the leg is driven to pierce the workpieces while allowing the front end of the leg to be expanded and deformed in its radial outward direction and to be stayed in the receiving-side workpiece adjacent to the die without passing therethrough to connect the plurality of workpieces with each other by the expanded leg and the head; and wherein the self-piercing rivet setting system comprises a first self-piercing rivet setting apparatus including a first die which has a first cavity, the first cavity of the first die member being adapted to allow the leg of the self-piercing rivet to be driven into the workpieces in a straight direction when the self-piercing rivet is pressed against the first die by the punch; a second self-piercing rivet setting apparatus including a second die which has a second cavity and a protruding pin provided at the center of the second cavity, the second cavity and protruding pin of the second die member being adapted to allow the leg of the self-piercing rivet being piercing the workpieces to be expanded and deformed in its radial outward direction; and exchanging means for placing the first self-piercing rivet setting apparatus with respect to the workpieces until the leg of the self-piercing rivet is driven into the workpieces in a straight direction and starts piercing the receiving-side workpiece, and for placing the second self-piercing rivet setting apparatus with respect to the workpiece in place of the first self-piercing rivet setting apparatus to allow the leg of the self-piercing rivet being piercing the receiving-side workpiece to be expanded and deformed in its radial outward direction when the leg of the self-piercing rivet starts piercing the receiving-side workpiece.

* * * * *

UNITED STATES PATENT AND TRADEMARK OFFICE

CERTIFICATE OF CORRECTION

PATENT NO. : 6,910,263 B2
DATED : June 28, 2005
INVENTOR(S) : Nobuharu Naitoh

It is certified that error appears in the above-identified patent and that said Letters Patent is hereby corrected as shown below:

Title page,
Item [12], "Naito" should be -- Naitoh --.
Item [75], Inventor, "Naito" should be -- Naitoh --.

Signed and Sealed this

Tenth Day of January, 2006

JON W. DUDAS
*Director of the United States Patent and Trademark Office*